US012644161B2

(12) United States Patent
Xiao et al.

(10) Patent No.: US 12,644,161 B2
(45) Date of Patent: Jun. 2, 2026

(54) INTEGRATED DRYING PROCESS AND DEVICE FOR DRY GRANULATED SLAG AND SLUDGE

(71) Applicant: BAOSHAN IRON & STEEL CO., LTD., Shanghai (CN)

(72) Inventors: Yongli Xiao, Shanghai (CN); Yongqian Li, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 538 days.

(21) Appl. No.: 18/018,677

(22) PCT Filed: Jun. 21, 2021

(86) PCT No.: PCT/CN2021/101238
§ 371 (c)(1),
(2) Date: Jan. 30, 2023

(87) PCT Pub. No.: WO2022/022161
PCT Pub. Date: Feb. 3, 2022

(65) Prior Publication Data

US 2023/0295754 A1 Sep. 21, 2023

(30) Foreign Application Priority Data

Jul. 31, 2020 (CN) ..... 202010758535.0

(51) Int. Cl.
*C21B 3/08* (2006.01)

(52) U.S. Cl.
CPC ..... *C21B 3/08* (2013.01); *C21B 2400/026* (2018.08); *C21B 2400/056* (2018.08); *C21B 2400/064* (2018.08)

(58) Field of Classification Search
CPC ..... C21B 3/08; C21B 2400/026; C21B 2400/056; C21B 2400/064;
(Continued)

(56) References Cited

U.S. PATENT DOCUMENTS

2014/0352496 A1 12/2014 Reichel et al.
2019/0203307 A1 7/2019 Li et al.

FOREIGN PATENT DOCUMENTS

CN 1858262 A 11/2006
CN 101387472 A * 3/2009
(Continued)

OTHER PUBLICATIONS

CN101387472 Translation (Year: 2009).*
(Continued)

*Primary Examiner* — Danielle M. Carda
(74) *Attorney, Agent, or Firm* — Lei Fang, Esq.; Smith Tempel Blaha LLC

(57) ABSTRACT

An integrated drying process and device for dry granulated slag and sludge are provided. The process comprises: 1) slag ball mixing and soaking: high-temperature slag and steel balls are fully mixed and exchange heat therebetween, the high-temperature slag is cooled because the heat thereof is quickly absorbed by the steel balls and is crushed to form granular slag, and the temperature of the steel balls rises because the steel balls absorb the heat of the high-temperature slag; and 2) sludge drying: the high-temperature steel balls are conveyed to a sludge drying device to be mixed with injected sludge, the sludge is dried, the steel balls are separated from the sludge when the water content of the sludge reaches a set value, and the steel balls and the sludge are separately discharged. With the present invention, cooperative treatment of slag cooling, granulation and sludge drying are obtained.

20 Claims, 2 Drawing Sheets

(58) Field of Classification Search
CPC ..... C21B 2400/066; C21B 2400/08; C21B 2400/022; C21B 2400/05; F26B 3/205; F26B 11/026; F26B 11/0472; F26B 11/0481; C02F 11/13; Y02P 10/20; Y02W 30/50
USPC ..... 75/380
See application file for complete search history.

(56) References Cited

FOREIGN PATENT DOCUMENTS

| | | | | |
|---|---|---|---|---|
| CN | 101885574 | A | | 11/2010 |
| CN | 201873694 | A | | 6/2011 |
| CN | 104512988 | A | | 4/2015 |
| CN | 108165686 | A | | 6/2018 |
| CN | 109293194 | A | | 2/2019 |
| CN | 109811095 | A | * | 5/2019 |
| CN | 110330211 | A | | 10/2019 |
| JP | 2002273480 | A | | 9/2002 |
| JP | 2019-520481 | A | | 7/2019 |
| RU | 2530914 | C1 | | 10/2014 |
| TW | 202026255 | A | | 7/2020 |
| WO | 2020063745 | A1 | | 4/2020 |

OTHER PUBLICATIONS

CN109811095 Translation (Year: 2019).*
Search report for RU App. 2023102336/05 (004987).
EP cf Form 1507 for App No. 21850176.5.
TW search report for TW App No.
International Search Report for PCT/CN2021/101238 dated Sep. 2, 2021.
International Written Opinion for PCT/CN2021/101238 dated Sep. 2, 2021.
1st CN Office Action dated 06012022 for priority doc. CN 202010758535.0.

* cited by examiner

INTEGRATED DRYING PROCESS AND DEVICE FOR DRY GRANULATED SLAG AND SLUDGE

CROSS-REFERENCE TO RELATED APPLICATIONS

This application is a 371 U.S. National Phase of PCT International Application No. PCT/CN2021/101238 filed on Jun. 21, 2021, which claims benefit and priority to Chinese patent application No. CN202010758535.0 filed on Jul. 31, 2020, the contents of each of the above listed applications are incorporated by reference herein in their entireties.

TECHNICAL FIELD

The present disclosure relates to the technical field of recovery of residual heat from metallurgical molten slag, in particular to an integrated process for dry granulation of molten slag and drying of sludge, and an apparatus therefor.

BACKGROUND ART

China is now the largest steel producer in the world. China's steel output has remained ranking No. 1 in the world for 16 consecutive years, far ahead of other countries. In 2019, the steel output in the mainland of China was 996 million tons. The heat contained in the molten slag generated in the process of steelmaking is huge. From the perspective of energy saving, environmental protection and promoting the economic benefits of steel plants, it's quite necessary to recover heat from blast furnace slag and realize resource utilization of blast furnace slag. The temperature of blast furnace slag leaving the furnace is generally between 1400 and 1550° C. The slag contains $(1260\text{-}1880)\times10^3$ kJ sensible heat/ton, equivalent to the calorific value of 60 kg standard coal. The production of 1 ton of pig iron is accompanied with 0.3 tons of blast furnace slag as a by-product, and the production of 1 ton of steel is accompanied with 0.13 tons of steel slag as a by-product. Based on 996 million tons of steel output, it may be calculated that at least 428 million tons of blast furnace slag and converter slag can be produced, of which the sensible heat is equivalent to 25.7 million tons of standard coal.

At present, the methods for treating blast furnace slag include dry slag pit cooling and water quenching. In the dry slag pit cooling method, molten blast furnace slag is poured into a dry slag pit for air cooling to solidify, followed by water cooling. This method causes pollution to underground water. A large quantity of water vapor is released during cooling, and a large quantity of $H_2S$ and $SO_2$ gases are emitted at the same time, leading to corrosion of buildings, damage of equipment and deterioration of working environment. Generally, this method is only used for accident handling. 90% of the blast furnace slag in China is treated with the water quenching method, and the water granulated slag obtained is used to produce cement, slag brick, slag powder and heat insulation filler. There are many ways for water quenching of blast furnace slag, and the main treatment processes include: OCP, INBA, RASA, TYNA, MTC, etc. Although the water quenching process is constantly developing, the core of the technology is to quench blast furnace slag by spraying water, cool it, granulate it into water granulated slag, and then separate the water granulated slag from water. The quenching water is subjected to settling and filtration, and then recycled.

The water quenching method cannot fundamentally change the water-consuming characteristic of the slag granulation process. The physical heat of the slag is nearly lost entirely. The emission of $SO_2$, $H_2S$ and other pollutants during the water quenching process not only affects the working environment, but also pollutes the air. The water quenching method has the following disadvantages:

1. The high-quality residual heat resource contained in the blast furnace slag is wasted. The liquid blast furnace slag having a temperature of 1350° C.-1450° C. is discharged from a taphole, and it is crushed and cooled by high-pressure water. At such a high temperature, most of the liquid water is quickly gasified into water vapor which is discharged into the atmosphere, thereby wasting a lot of heat contained in this part of water vapor. From the perspective of energy utilization efficiency, the residual heat of liquid blast furnace slag is of very high quality, and has great utilization value.
2. A huge amount of water is wasted. In the process of water quenching, the water pressure is greater than 0.2 MPa, and the ratio of slag to water is 1:10. 0.8-1.2 tons of fresh water is consumed per ton of slag. Currently, China's output of blast furnace pig iron exceeds 680 million tons; the annual output of blast furnace slag is about 200 million tons; and the consumption of fresh water for quenching slag is about 200 million tons.
3. Harmful gases such as $SO_2$ and $H_2S$ are produced and pollute the environment. A large amount of $H_2S$ and $SO_x$ are produced during the water quenching process, and they are discharged into the atmosphere along with the water vapor. When they accumulate to a certain extent, they will induce acid rain.

In respect of recovery of residual heat from blast furnace slag, the use of the residual heat recovered during the water quenching is limited to heating with the residual heat of the quenching water, supplying hot water in bathrooms, etc. The recovery rate of the residual heat is low, only about 10%. Moreover, the use is limited by time and area. In summer and in districts without heating facilities, this part of energy can only be wasted. Thus, the popularization and application of this method are limited. At present, a hot subject in the development of technologies for recovering sensible heat from blast furnace slag is the dry recovery method. It is more water-saving and environmentally friendly than the existing water quenching method, and it is in line with the concept of sustainable development.

The earlier processes that achieved certain effects mainly include internal cooling rotating drum process, roller granulation process, air quenching process, mechanical stirring process, continuous casting and rolling process in Japan, and centrifugal spinning disc process in Britain. The current technologies have the following problems:

1. The granulation effect is not good, which is not conducive to further utilization of the resulting granulated slag. The cold slag obtained by the internal cooling rotating drum process is discharged in the form of flakes. This form is not conducive to further utilization of the slag. The particle diameter distribution of the granulated slag obtained by the air quenching process is wide, which is not conducive to subsequent treatment. The flat-plate-like slag obtained by the continuous casting and rolling process is in the form of large flakes, which is not conducive to further utilization of the slag.
2. The quality of the heat exchanged gas is not high. A fluidized bed is used in the centrifugal spinning disc process for heat exchange. The bed layer is back-mixed violently. The outlet temperature is not high, namely 400-500° C. The energy quality is low, and the high temperature heat source has not been effectively utilized.

3. The heat recovery efficiency is low. The internal heat medium used in the internal cooling rotating drum process absorbs about 40% of the sensible heat of the molten slag. The air permeability of the high temperature flat-plate-like slag obtained by the continuous casting and rolling process seriously affects the efficiency of heat exchange between the cold air and the water-cooling wall.
4. The vitrification degree is not high, and the added value is low. The roller granulation process is semi-quenching treatment, and the resulting product is concrete aggregate having low added value. The slag particles obtained by the mechanical stirring process have a large and nonuniform size, and the vitrification degree is not high, so they can only be used as a paving material.
5. The operation cost of the equipment is high, and the investment is large. The air quenching process consumes a lot of power during the granulation process, and the cooling speed of the air quenching process is relatively slow. In order to prevent the granulated slag from adhering to the surface of the equipment before it is consolidated, the equipment needs to have a large size, which increases the investment cost.

The technology currently used for water quenching metallurgical slag not only causes waste of high-quality residual heat contained in blast furnace slag, but also causes waste of a large volume of fresh water. At the same time, it causes very serious pollution to the environment. This method is far from being able to adapt to the development mode of new industrialization and circular economy, and must be fundamentally changed or discarded. On the other hand, the dry granulation processes for blast furnace slag are technically immature at present, some of which have low efficiency, some of which affect the performances of the slag and reduce its added value, some of which require large investment in equipment, etc. These problems cannot be solved effectively.

In recent years, there has been an obvious trend of growth in sludge production. At present, the total annual discharge of wastewater in China exceeds $400\times10^8$ t; the annual discharge of dry sludge is about $5.50\times10^6$-$6.00\times10^6$ t; and they continue to increase. One reason is that the population served by the sewage pipe network is increasing continuously, and the other reason is that the water discharge standards are more and more stringent.

Sludge is generally defined in China as a semi-solid or solid substance produced in the process of sewage treatment, and it's a complex heterogeneous body composed of organic matter, bacteria, inorganic particles, and colloids. If classified according to the source of sludge, there are mainly water supply sludge, industrial wastewater sludge and domestic sewage sludge. According to the sewage treatment process, sludge may be classified into the following categories: primary sludge, activated sludge, humic sludge, chemical sludge, etc. The moisture content of sludge mainly depends on the type of solids in the sludge and the particle size. Generally, the finer the solid particles, and the more organic matter the slag contains, then the higher the water content of the sludge. The moisture content or solid content of the sludge is closely related with the sludge volume. For example, when the moisture content of the sludge drops from 95% to 90%, the sludge volume will be reduced by half. Hence, reducing the moisture content of the sludge is of great significance.

A sludge drying technology is the premise and basis for implementing treatment and resource utilization of sludge. The traditional sludge drying technology has high energy cost. When the moisture content of sludge is decreased from 80% to 20%, the energy consumption for drying one ton of sludge exceeds 740 KWH of electricity, equivalent to about 90 kg of standard coal. This seriously restricts the development and application of the sludge drying technology.

SUMMARY

One object of the present disclosure is to provide an integrated process for dry granulation of molten slag and drying of sludge, and an apparatus for the same, wherein the residual heat of high temperature molten slag is used to dry sludge, so as to realize coordinated treatment including slag cooling, slag granulation and sludge drying. The two tough problems concerning high temperature molten slag cooling and sludge drying are thus addressed. Moreover, the recycling rate of the residual heat of high temperature molten slag is increased greatly.

To achieve the above object, the technical solution adopted in the present disclosure is as follows:

A method for molten slag cooling, granulation and sludge drying, comprising steps of:

1) Slag—Ball Mixing and Soaking

Mixing high temperature molten slag and steel balls at a weight ratio of 1:50-100 in a molten slag cooling treatment device, wherein the high temperature molten slag and steel balls are fully and evenly mixed and heat exchanged by tumbling the high temperature molten slag and steel balls, wherein the steel balls absorb heat from the high temperature molten slag, while the high temperature molten slag is gradually cooled and crushed by the steel balls to form granular slag having a particle diameter of ≤150 mm and a temperature of lower than 400° C.; wherein the steel balls having absorbed heat have a temperature of 200-400° C.;

2) Slag—Ball Separation

Discharging the granular slag through a slag discharge mechanism, and discharging the steel balls having absorbed heat into a high temperature steel ball chute;

3) Sludge Drying

Transporting the steel balls having absorbed heat to a sludge drying device through the high temperature steel ball chute to mix with sludge infused into the sludge drying device, wherein the sludge drying device is driven by a driving device to rotate so that the sludge and steel balls in the sludge drying device tumble, and fully and evenly mix and exchange heat, whereby the sludge is dried by the steel balls having absorbed heat; wherein the steel balls and dried sludge are separated when a moisture content of the sludge reaches a set value; wherein the dried sludge is discharged through a dry sludge discharge device, and the steel balls cooled by the sludge are discharged through an outlet; wherein a mass ratio of the steel balls to the infused sludge is 2-10:1.

In some embodiments, the present disclosure provides an integrated process for dry granulation of molten slag and drying of sludge, comprising steps of:

1) Slag—Ball Mixing and Soaking

Transporting high temperature molten slag and steel balls respectively to a molten slag cooling treatment device, wherein the molten slag cooling treatment device is driven by a driving device to rotate so that the high temperature molten slag and steel balls in the molten slag cooling treatment device tumble, and fully and evenly mix and exchange heat, wherein the steel balls absorb heat from the high temperature molten slag, while the high temperature molten slag is gradually cooled and crushed by the steel balls to form granular slag having a particle diameter of ≤150 mm and a temperature of lower than 400° C.; wherein the granular slag and the steel balls are separated, wherein the granular slag is discharged through a slag discharge mechanism, and the steel balls having absorbed heat are discharged into a high temperature steel ball chute; wherein a weight ratio of the high temperature molten slag to the steel balls is 1:50-100, and the steel balls having absorbed heat have a temperature of 200-400° C.;

2) Sludge Drying

Transporting the steel balls having absorbed heat to a sludge drying device through the high temperature steel ball chute to mix with sludge infused into the sludge drying device, wherein the sludge drying device is driven by a driving device to rotate so that the sludge and steel balls in the sludge drying device tumble, and fully and evenly mix and exchange heat, whereby the sludge is dried by the steel balls having absorbed heat; wherein the steel balls and dried sludge are separated when a moisture content of the sludge reaches a set value; wherein the dried sludge is discharged through a dry sludge discharge device, and the steel balls cooled by the sludge are discharged through an outlet; wherein a mass ratio of the steel balls to the infused sludge is 2-10:1.

Further, the cooled steel balls are transported and returned to the molten slag cooling treatment device, thereby forming a cyclic treatment process.

Preferably, an initial moisture content of the sludge is 30-95%, and a moisture content of the dried sludge is 3-10%.

Further, after the granular slag is discharged by the slag discharge mechanism, it is collected by a cold slag collection device and transferred to a cold slag bin below for subsequent resource treatment and utilization.

Further, the slag discharge mechanism is disposed at a tail of the molten slag cooling treatment device.

Further, the dried sludge is discharged through the dry sludge discharge device, collected by a dry sludge collector, and then sent to a dried sludge bin below for subsequent resource treatment and utilization.

According to the present disclosure, the size of the steel balls is not particularly limited as long as they can crush the high temperature molten slag to form granular slag having a particle diameter of ≤150 mm. An exemplary steel ball diameter may be 80 mm-200 mm.

In the integrated method and process for dry granulation of molten slag and drying of sludge according to the present disclosure:

The high temperature molten slag enters the molten slag cooling treatment device through a molten slag feeding hopper, and the steel balls used as a molten slag cooling medium are transported from the molten slag feeding hopper to the molten slag feeding hopper, and mixed with the high temperature molten slag. The inner wall of the molten slag cooling treatment device is provided with a slag-ball propulsion mechanism (such as a spiral shoveling plate). As the molten slag cooling treatment device rotates, the steel balls and high temperature molten slag are mixed evenly, and the high temperature molten slag is gradually cooled and crushed by the steel balls. At the same time, heat is transferred from the high temperature molten slag to the steel balls. After the high temperature molten slag is cooled and crushed, granular slag having a particle diameter of ≤150 mm and a temperature of lower than 400° C. is formed. The cooled and solidified granular slag is discharged through the slag discharge mechanism at the tail of the molten slag cooling treatment device, collected by the cold slag collection device, and transferred to a cold slag bin below for subsequent resource treatment and utilization. The steel balls having absorbed heat continue to advance along with the rotation of the molten slag cooling treatment device, and are discharged to the high temperature steel ball chute.

The temperature of the steel balls having absorbed heat is 200-400° C. The steel balls are transported by the high temperature steel ball chute to mix with the sludge transported by a sludge transporting device, and enter the sludge drying device. The inner wall of the sludge drying device is also provided with a sludge-ball propulsion mechanism (such as a spiral shoveling plate). Under the action of the sludge-ball propulsion mechanism (such as a spiral shoveling plate), the steel balls and sludge are transported forward while mixing and drying are implemented. When the sludge is dried to a set moisture content, it is discharged through the dry sludge discharge device at the tail of the sludge drying device, collected by the dry sludge collector, and then sent to the dried sludge bin below for subsequent resource treatment and utilization. The moisture content of the dried sludge may be set according to different requirements of users. The process parameters may be adjusted to achieve the required moisture content of the dried sludge. Generally, the initial moisture content of the sludge is 30-95% by weight, and the moisture content of the dried sludge can reach 3-10% by weight.

The steel balls discharged from the sludge drying device enter a low temperature steel ball chute along which the steel balls are transported to a steel ball transporting device. Under the driving action of gravity and a pushing mechanism, the steel balls are discharged from an outlet of the steel ball transporting device, and enter the molten slag feeding hopper of the molten slag cooling treatment device. As such, the steel balls can move in cycles, and are used repeatedly.

The apparatus for the integrated process for dry granulation of molten slag and drying of sludge according to the present disclosure comprises:

- A molten slag cooling treatment device having a cylinder structure, comprising: a propulsion mechanism provided on an inner wall thereof, a molten slag feeding hopper provided at an inlet thereof, and a slag discharge mechanism provided at an outlet thereof; wherein the molten slag cooling treatment device is provided with a first driving device configured to drive it to rotate;
- A plurality of steel balls, a steel ball transporting device coupled to the inlet of the molten slag cooling treatment device, and a high temperature steel ball chute, one end of which is coupled to the outlet of the molten slag cooling treatment device;
- A sludge drying device having a cylinder structure, comprising: a propulsion mechanism provided on an inner wall thereof, a sludge transporting device provided at an inlet thereof, and a dry sludge discharge device provided at an outlet thereof, wherein the sludge drying device is coupled to a second driving device configured to drive it to rotate; wherein the inlet of the sludge drying device is coupled to the other end of the high temperature steel ball chute.

In the present disclosure, the molten slag cooling treatment device is used to cool molten slag; and the sludge drying device is used to dry sludge. The high temperature steel ball chute is used to receive the high temperature steel balls coming from the molten slag cooling treatment device and separated from the granular slag, so that they can be sent to the sludge drying device. The low temperature steel ball chute is used to receive the steel balls coming from the sludge drying device and separated from the dried sludge, so that they can be sent to the steel ball transporting device.

Further, the apparatus for the integrated process for dry granulation of molten slag and drying of sludge according to the present disclosure further comprises a low temperature steel ball chute, one end of which is coupled to the outlet of the sludge drying device, and the other end of which is coupled to a steel ball inlet of the steel ball transporting device.

Further, the steel ball inlet of the steel ball transporting device is communicated with the outlet of the sludge drying device via the low temperature steel ball chute; a steel ball outlet of the steel ball transporting device is coupled to the molten slag feeding hopper of the molten slag cooling treatment device; and the molten slag cooling treatment device is communicated with the inlet of the sludge drying device via the high temperature steel ball chute.

Further, the steel ball inlet of the steel ball transporting device is communicated with the outlet of the sludge drying device via the low temperature steel ball chute, and a steel ball outlet of the steel ball transporting device is coupled to the molten slag feeding hopper of the molten slag cooling treatment device, such that the molten slag cooling treatment device, the steel ball transporting device, and the sludge drying device are arranged in an end-to-end triangular configuration.

Preferably, the steel ball transporting device is disposed with its outlet end oriented obliquely upward at an inclination angle of 25°-80° relative to a horizontal plane.

Preferably, the steel ball transporting device has a cylinder structure and comprises a propulsion mechanism provided on an inner wall thereof, wherein the steel ball transporting device is coupled to a driving device configured to drive it to rotate.

Preferably, the molten slag cooling treatment device and the sludge drying device are arranged in such a manner that an acute angle is formed therebetween.

Preferably, the molten slag cooling treatment device is disposed horizontally, or disposed with its inlet end oriented obliquely downward at an inclination angle of 0°-45°, preferably 5°-15°.

Preferably, the sludge drying device is disposed horizontally, or disposed with its outlet end oriented obliquely downward at an inclination angle of 0°-15°.

Preferably, the slag discharge mechanism and the dry sludge discharge device are provided with a tail gas collection and discharge device.

Preferably, the first driving device and the second driving device each comprise a ring gear disposed on the molten slag cooling treatment device or the sludge drying device, and a driving gear meshed with the ring gear, wherein the driving gear is disposed on an output end of a reducer coupled to a motor.

Preferably, the third driving device comprises a ring gear disposed on the steel ball transporting device, and a driving gear meshed with the ring gear, wherein the driving gear is disposed on an output end of a reducer coupled to a motor.

Preferably, the propulsion mechanism is a spiral shoveling plate.

In the design of the apparatus for the integrated process for dry granulation of molten slag and drying of sludge according to the present disclosure:

By the arrangement of the molten slag cooling treatment device, sludge drying device and steel ball transporting device according to the present disclosure, not only rapid granulation of high temperature molten slag and recovery of residual heat are realized, but drying of sludge is also realized; not only the challenge of effective utilization of the residual heat of a huge amount of molten slag in the iron and steel industry is addressed, but broad prospects are also opened up for the treatment and resource utilization of urban sludge. Moreover, as a preferred design, the three devices can be connected end to end and arranged in a triangular configuration to form a cyclic treatment system, so that the whole apparatus is more compact and more efficient.

In the present disclosure, a tail gas collection and discharge device is further provided on the slag discharge mechanism to collect the dust generated during the cooling and crushing of the high temperature molten slag, and then discharge the tail gas after subsequent treatment by a corresponding tail gas purification device to meet the standards. A tail gas collection and discharge device is provided on the dry sludge discharge device to collect the tail gas containing dust and water vapor generated in the sludge drying process, and then discharge the tail gas after subsequent treatment by a corresponding tail gas purification device to meet the standards, thereby realizing environmentally friendly treatment.

The molten slag cooling treatment device, sludge drying device and steel ball transporting device each are provided with supporting devices at both ends. The supporting device comprises supporting mechanisms including a supporting ring and a supporting wheel. The inclination angle between each device and the horizontal plane can be adjusted by adjusting the supporting device.

In the present disclosure, the temperature of the high temperature molten slag is generally ≥1300° C., for example, 1350° C.-1500° C. After sufficient heat exchange with the sludge, the temperature of the high temperature steel balls usually drops to 150° C. or lower (that is, the temperature of the low temperature steel balls described herein).

The beneficial effects of the present disclosure include:

1. Molten Slag Cooling and Sludge Drying are Implemented in Coordination.

According to the present disclosure, the two different technical fields and industries of molten slag treatment and sludge drying are linked organically. Not only the molten slag is cooled and granulated effectively, but the residual heat is also recovered and used efficiently. The residual heat recovered from the molten slag is used to achieve low-cost drying of sludge. This not only solves the tough problem of effective utilization of the residual heat of a huge amount of molten slag in the iron and steel industry, but also opens up broad prospects for the treatment and resource utilization of urban sludge. The two tough problems concerning molten slag cooling and sludge drying are solved at the same time.

2. The Overall Process According to the Present Disclosure is Fast, Stable and Continuous.

In the present disclosure, steel balls are used as an efficient cooling medium and a heat retainer to continuously recover heat from the molten slag and transfer the heat to the low temperature sludge. Furthermore, the steel balls can be used repeatedly due to cyclic transfer, so that the molten slag and sludge can be treated stably and continuously.

3. The Molten Slag is Treated with High Efficiency.

The molten slag is cooled and granulated continuously and dynamically. This overcomes the shortcomings of long-term static cooling and slow heat exchange in conventional processes. The treatment efficiency of the molten slag is improved greatly.

4. The Utilization Rate of the Heat Energy of the Molten Slag is High.

The temperature of the molten slag is high, and the quality of the heat energy carried by the molten slag is high. However, similar to refractory materials, the molten slag has a very small thermal conductivity and releases heat slowly. The heat energy carried thereby is difficult to recover and utilize through conventional processes. Because the thermal conductivity of steel is relatively large, it can absorb and release heat quickly. Thus, when steel balls are used as a heat transfer medium, they can absorb the heat of the molten slag quickly and become high temperature steel balls during contact and mixing of the steel balls with the molten slag. When the high temperature steel balls are mixed with the sludge, they can release the heat therein quickly and transfer the heat to the sludge to achieve drying of the sludge.

5. The Sludge is Dried with High Efficiency.

In the present disclosure, the steel balls which have absorbed heat are in direct contact with the sludge, and stirred repeatedly, so that the heat exchange area is large, and the drying efficiency is high.

6. There are Many Varieties and Wide Ranges of Dried Sludge.

In the present disclosure, the steel balls which have absorbed heat are used to dry the sludge. As a heat transfer medium, the steel balls have a clean surface. The molten slag and the sludge do not contact each other, and thus the molten slag and the sludge do not contaminate each other. Therefore, the sludge drying is not restricted by the type of molten slag or the type of sludge. Blast furnace slag, converter slag and other slag can all provide heat, and inorganic sludge and organic sludge can both be dried.

Reference numbers include: 1, molten slag cooling treatment device; 2, steel ball; 3, steel ball transporting device; 4, high temperature steel ball chute; 5, sludge drying device; 6, low temperature steel ball chute; 7, steel ball chute; 8, tail gas collection and discharge device; 9, supporting device; 11, 31, 51, propulsion mechanism; 12, molten slag feeding hopper; 13, slag discharge mechanism; 14, first driving device; 16, cold slag collection device; 17, cold slag bin; 18, dry sludge collector; 19, dried sludge bin; 52, sludge transporting device; 53, dry sludge discharge device; 54, second driving device; 32, third driving device; 100, high temperature slag; 200, sludge.

DETAILED DESCRIPTION

Figure 1:
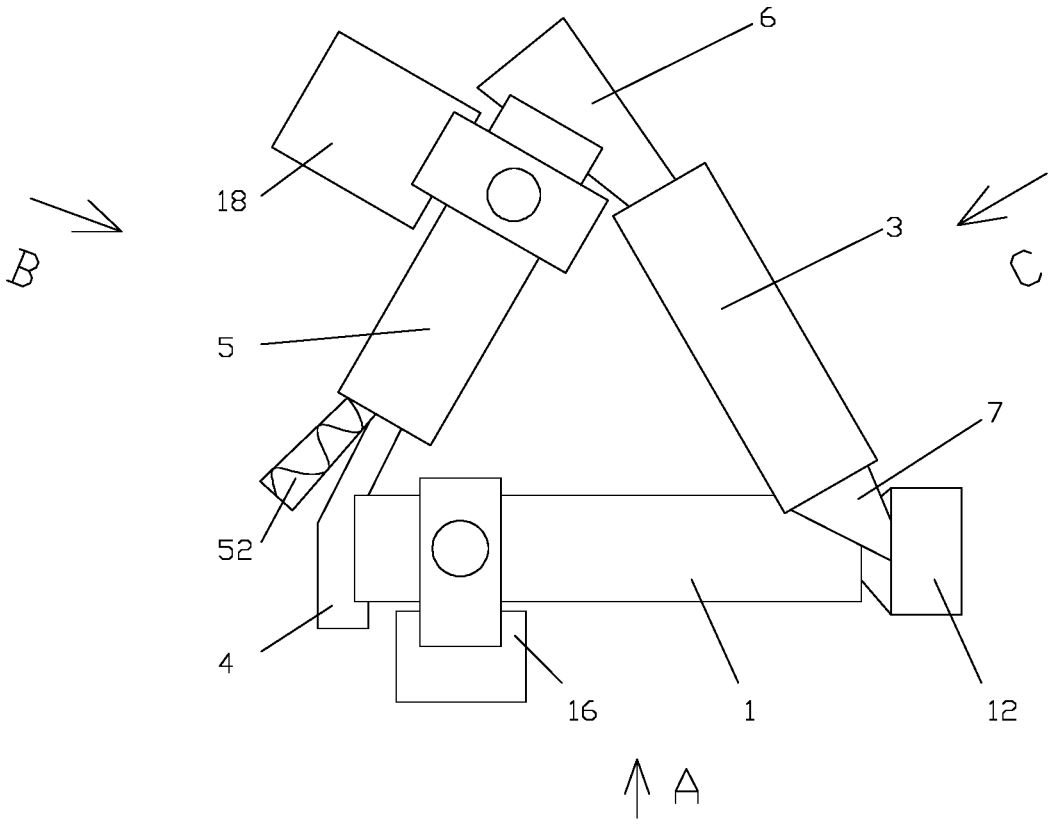
FIG. 1 is a schematic view illustrating the structure of an apparatus for integrated dry granulation of molten slag and drying of sludge according to the present disclosure.
Figure 2:
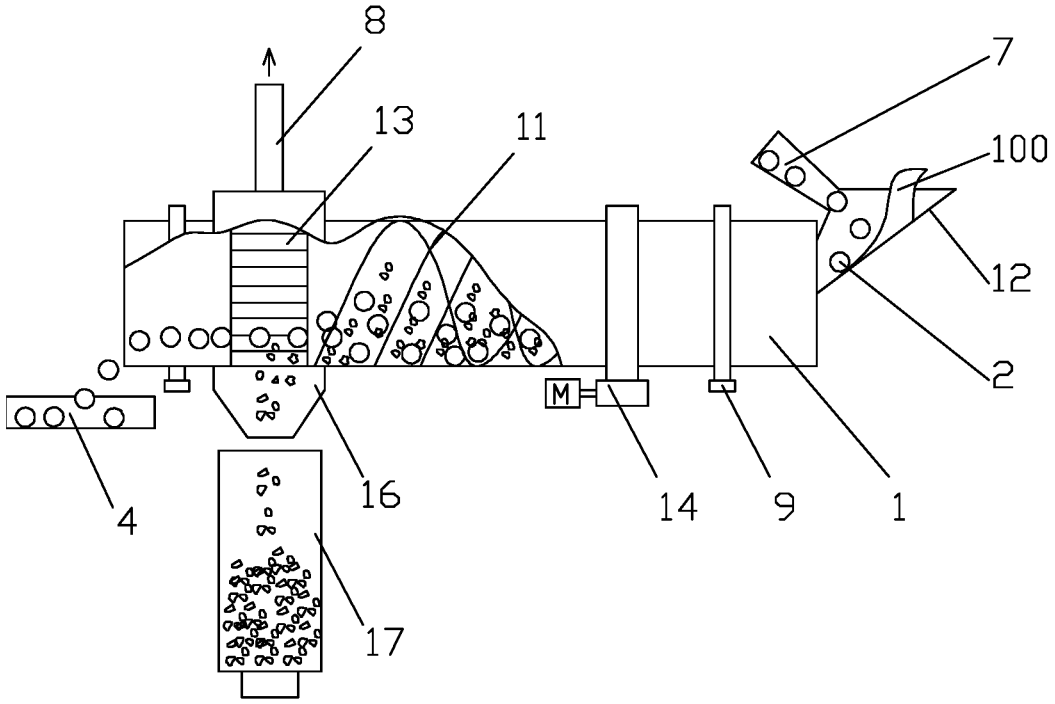
FIG. 2 is a view in direction A in FIG. 1.
Figure 3:
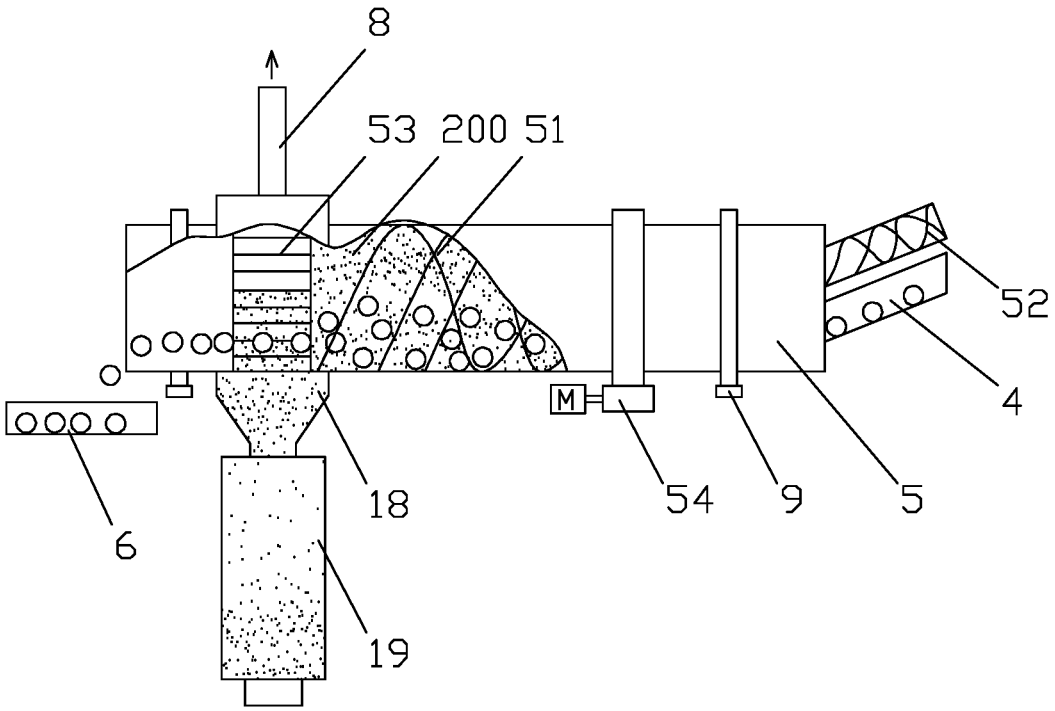
FIG. 3 is a view in direction B in FIG. 1.
Figure 4:
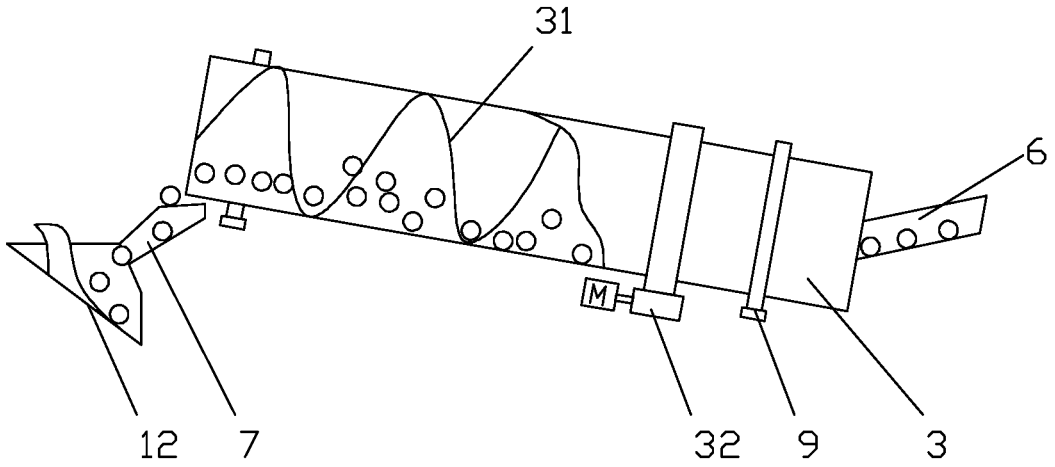
FIG. 4 is a view in direction C in FIG. 1.

Referring to FIGS. 1-4, the apparatus for integrated dry granulation of molten slag and drying of sludge according to the present disclosure comprises:

A molten slag cooling treatment device 1 having a cylinder structure, comprising: a propulsion mechanism 11 provided on an inner wall thereof, a molten slag feeding hopper 12 provided at an inlet thereof, and a slag discharge mechanism 13 provided at an outlet thereof; wherein the molten slag cooling treatment device 1 is provided with a first driving device 14 configured to drive it to rotate;

A plurality of steel balls 2, and a steel ball transporting device 3 coupled to the inlet of the molten slag cooling treatment device 1;

A high temperature steel ball chute 4, one end of which is coupled to the outlet of the molten slag cooling treatment device 1;

A sludge drying device 5 having a cylinder structure, comprising: a propulsion mechanism 51 provided on an inner wall thereof, a sludge transporting device 52 provided at a sludge inlet, and a dry sludge discharge device 53 provided at an outlet, wherein the sludge drying device 5 is coupled to a second driving device 54 configured to drive it to rotate; wherein the inlet of the sludge drying device 5 is coupled to the other end of the high temperature steel ball chute 4.

Further, a steel ball inlet of the steel ball transporting device 3 is communicated with the outlet of the sludge drying device 5 via a low temperature steel ball chute 6, and a steel ball outlet of the steel ball transporting device 3 is coupled to the molten slag feeding hopper 12 of the molten slag cooling treatment device 1 via a steel ball chute 7, such that the molten slag cooling treatment device 1, the steel ball transporting device 3, and the sludge drying device 5 are arranged in an end-to-end triangular configuration.

Preferably, the steel ball transporting device 3 is disposed with its outlet end oriented obliquely upward at an inclination angle of 25°-80° relative to a horizontal plane.

Preferably, the steel ball transporting device 3 has a cylinder structure and comprises a propulsion mechanism 31 provided on an inner wall thereof, wherein the steel ball transporting device 3 is coupled to a third driving device 32 configured to drive it to rotate.

Preferably, the molten slag cooling treatment device 1 is disposed with its inlet end oriented obliquely downward at an inclination angle of 0°-45°, preferably 5°-15° relative to a horizontal plane.

Preferably, the sludge drying device 5 is disposed horizontally, or disposed with its outlet end oriented obliquely downward at an inclination angle of 0°-15° relative to a horizontal plane.

Preferably, the slag discharge mechanism 13 and the dry sludge discharge device 53 are provided with a tail gas collection and discharge device 8.

Preferably, the first driving device 14 and the second driving device 54 each comprise a ring gear disposed on the molten slag cooling treatment device or the sludge drying device, and a driving gear meshed with the ring gear, wherein the driving gear is disposed on an output end of a reducer coupled to a motor.

Preferably, the third driving device 32 comprises a ring gear disposed on the steel ball transporting device, and a driving gear meshed with the ring gear, wherein the driving gear is disposed on an output end of a reducer coupled to a motor.

Preferably, the propulsion mechanisms 11, 51, 31 each are a spiral shoveling plate.

Preferably, the molten slag cooling treatment device 1, the sludge drying device 5 and the steel ball transporting device 3 each are provided with supporting devices 9 at both ends.

Preferably, the slag discharge mechanism 13 is coupled to a cold slag collection device 16, and a cold slag bin 17 is provided below the cold slag collection device 16.

Preferably, the dry sludge discharge device 53 is coupled to a dry sludge collector 18, and a dried sludge bin 19 is provided below the dry sludge collector 18.

The integrated process for dry granulation of slag and drying of sludge according to the present disclosure comprises:

1) Slag—Ball Mixing and Soaking

High temperature molten slag 100 and a plurality of steel balls 2 are first sent to a rotating molten slag cooling treatment device 1 through a slag feeding hopper 12 to fulfil slag-ball mixing. The high temperature molten slag 100 is gradually cooled and crushed by the steel balls 2, and transfers its heat to the steel balls 2. The high temperature molten slag 100 is gradually cooled and crushed by the steel balls to form granular slag having a particle diameter of ≤150 mm and a temperature of lower than 400° C. The granular slag is discharged through a slag discharge mechanism 13 at the tail of the molten slag cooling treatment device 1, collected by a cold slag collection device 16, and transferred to a cold slag bin 17 below for subsequent resource treatment and utilization. The high temperature steel balls 2 having absorbed heat continue to advance as the molten slag cooling treatment device 1 rotates, and are discharged to a high temperature steel ball chute 4. The weight ratio of the high temperature molten slag to the steel balls is 1:50-100, and the temperature of the steel balls having absorbed heat is 200-400° C.

2) Sludge Drying

The high temperature steel balls 2 are transported to the sludge drying device 5 through the high temperature steel ball chute 4, and mixed at the inlet with the sludge 200 infused through a sludge transporting device 52. The mass ratio of the steel balls to the infused sludge is 2-10:1. The sludge drying device 5 rotates under the drive of a second driving device 54, so that the sludge 200 and the steel balls 2 in it tumble, and fully and evenly mix and exchange heat. The sludge 200 is dried by the high temperature steel balls 2. When the moisture content of the sludge 200 reaches a set value, the steel balls 2 are separated from the sludge 200. The sludge 200 is discharged through a dry sludge discharge device 53, collected by a dry sludge collector 18, and sent to a dried sludge bin 19 below for subsequent resource treatment and utilization. The cooled steel balls 2 are discharged through the outlet.

Further, the steel balls 2 discharged from the sludge drying device 5 enter a low temperature steel ball chute 6 along which the steel balls are transported to a steel ball transporting device 3. Under the driving action of gravity and a pushing mechanism 31, the steel balls 2 are discharged from an outlet of the steel ball transporting device 3, and enter the molten slag feeding hopper 12 of the slag cooling treatment device 1, forming a cyclic treatment process.

The process control parameters in the Examples of the present disclosure are listed in Table 1 in detail.

TABLE 1

| No. | Weight ratio of high temperature molten slag to steel balls | Molten slag temperature ° C. | Granular slag particle diameter mm | Granular slag temperature ° C. | Temperature of steel balls having absorbed heat ° C. | Weight ratio of steel balls to infused sludge | Initial moisture content of sludge % | Moisture content of dried sludge % |
|---|---|---|---|---|---|---|---|---|
| Ex. 1 | 1:50 | 1500 | 150 | 385 | 365 | 2:1 | 30 | 5.8 |
| Ex. 2 | 1:60 | 1500 | 120 | 378 | 350 | 2:1 | 48 | 8.5 |
| Ex. 3 | 1:70 | 1450 | 100 | 350 | 335 | 6:1 | 45 | 3.5 |
| Ex. 4 | 1:75 | 1450 | 80 | 353 | 337 | 3:1 | 75 | 6.6 |
| Ex. 5 | 1:80 | 1500 | 50 | 367 | 343 | 7:1 | 75 | 5.2 |
| Ex. 6 | 1:85 | 1450 | 70 | 345 | 321 | 4:1 | 82 | 7.5 |
| Ex. 7 | 1:90 | 1400 | 90 | 335 | 306 | 6:1 | 82 | 7.3 |
| Ex. 8 | 1:100 | 1350 | 80 | 305 | 268 | 8:1 | 95 | 4.8 |

What is claimed is:

1. An apparatus for molten slag cooling, granulation and sludge drying, comprising:

a) a molten slag cooling treatment device having a cylinder structure, comprising: a propulsion mechanism provided on an inner wall of the molten slag cooling treatment device, a molten slag feeding hopper provided at an inlet of the molten slag cooling treatment device, and a slag discharge mechanism provided at an outlet of the molten slag cooling treatment device; wherein the molten slag cooling treatment device is provided with a first driving device configured to drive the molten slag cooling treatment device to rotate;

b) a plurality of steel balls, and a steel ball transporting device coupled to the inlet of the molten slag cooling treatment device;

c) a high temperature steel ball chute, one end of which is coupled to the outlet of the molten slag cooling treatment device; and d) a sludge drying device having a cylinder structure, comprising: a propulsion mechanism provided on an inner wall of the sludge drying device, a sludge transporting device provided at an inlet of the sludge drying device, and a dry sludge discharge device provided at an outlet of the sludge drying device, wherein the sludge drying device is provided with a second driving device configured to drive the sludge drying device to rotate; wherein the inlet of the sludge drying device is coupled to the other end of the high temperature steel ball chute;

wherein the apparatus further comprises a low temperature steel ball chute, one end of which is coupled to the outlet of the sludge drying device, and the other end of which is coupled to a steel ball inlet of the steel ball transporting device; and wherein the steel ball inlet of the steel ball transporting device is communicated with the outlet of the sludge drying device via the low temperature steel ball chute, and a steel ball outlet of the steel ball transporting device is coupled to the molten slag feeding hopper of the molten slag cooling treatment device, such that the molten slag cooling treatment device, the steel ball transporting device, and the sludge drying device are arranged in an end-to-end triangular configuration.

2. The apparatus of claim 1, wherein the steel ball transporting device is disposed with an outlet end of the steel ball transporting device oriented obliquely upward at an inclination angle of 25°-80°.

3. The apparatus of claim 1, wherein the steel ball transporting device has a cylinder structure and comprises a propulsion mechanism provided on an inner wall thereof, wherein the steel ball transporting device is provided with a third driving device configured to drive the steel ball transporting device to rotate.

4. The apparatus of claim 3, wherein the third driving device comprises a ring gear disposed on the steel ball transporting device, and a driving gear meshed with the ring gear, wherein the driving gear is disposed on an output end of a reducer coupled to a motor.

5. The apparatus of claim 3, wherein the propulsion mechanism is a spiral shoveling plate.

6. The apparatus of claim 1, wherein the molten slag cooling treatment device and the sludge drying device are arranged in such a manner that an acute angle is formed therebetween.

7. The apparatus of claim 1, wherein the molten slag cooling treatment device is disposed horizontally, or disposed with an inlet end of the molten slag cooling treatment device oriented obliquely downward at an inclination angle of 0°-45°.

8. The apparatus of claim 7, wherein the molten slag cooling treatment device is disposed horizontally, or disposed with an inlet end of the molten slag cooling treatment device oriented obliquely downward at an inclination angle of 5°-15°.

9. The apparatus of claim 1, wherein the sludge drying device is disposed horizontally, or disposed with an outlet end of the sludge drying device oriented obliquely downward at an inclination angle of 0°-15°.

10. The apparatus of claim 1, wherein the slag discharge mechanism and the dry sludge discharge device are provided with a tail gas collection and discharge device.

11. The apparatus of claim 1, wherein the first driving device and the second driving device each comprise a ring gear disposed on the molten slag cooling treatment device or the sludge drying device, and a driving gear meshed with the ring gear, wherein the driving gear is disposed on an output end of a reducer coupled to a motor.

12. The apparatus of claim 1, wherein the propulsion mechanism is a spiral shoveling plate.

13. A method for molten slag cooling, granulation and sludge drying performed with the apparatus of claim 4, comprising steps of:

1) mixing high temperature molten slag and steel balls at a weight ratio of 1:50-100 in a molten slag cooling treatment device, wherein the high temperature molten slag and steel balls are fully and evenly mixed and heat exchanged by tumbling the high temperature molten slag and steel balls, wherein the steel balls absorb heat from the high temperature molten slag, while the high temperature molten slag is gradually cooled and crushed by the steel balls to form granular slag having a particle diameter of ≤150 mm and a temperature of lower than 400° C.; wherein the steel balls having absorbed heat have a temperature of 200-400° C.;

2) discharging the granular slag through a slag discharge mechanism, and discharging the steel balls having absorbed heat into a high temperature steel ball chute;

3) transporting the steel balls having absorbed heat to a sludge drying device through the high temperature steel ball chute to mix with sludge infused into the sludge drying device, wherein the sludge drying device is driven by a driving device to rotate so that the sludge and steel balls in the sludge drying device tumble, and fully and evenly mix and exchange heat, whereby the sludge is dried by the steel balls having absorbed heat; wherein the steel balls and dried sludge are separated when a moisture content of the sludge reaches a set value; wherein the dried sludge is discharged through a dry sludge discharge device, and the cooled steel balls are discharged through an outlet; wherein a mass ratio of the steel balls to the infused sludge is 2-10:1.

14. The method of claim 13, wherein the cooled steel balls are transported and returned to the molten slag cooling treatment device, thereby forming a cyclic treatment process.

15. The method of claim 13, wherein an initial moisture content of the sludge is 30-95%, and a moisture content of the dried sludge is 3-10%.

16. The method of claim 13, wherein the steel ball transporting device is disposed with an outlet end of the steel ball transporting device oriented obliquely upward at an inclination angle of 25°-80°.

17. The method of claim 13, wherein the steel ball transporting device has a cylinder structure and comprises a propulsion mechanism provided on an inner wall thereof, wherein the steel ball transporting device is provided with a third driving device configured to drive the steel ball transporting device to rotate.

18. The method of claim 13, wherein the molten slag cooling treatment device and the sludge drying device are arranged in such a manner that an acute angle is formed therebetween.

19. The method of claim 13, wherein the molten slag cooling treatment device is disposed horizontally, or disposed with an inlet end of the molten slag cooling treatment device oriented obliquely downward at an inclination angle of 0°-45°.

20. The method of claim 13, wherein the sludge drying device is disposed horizontally, or disposed with an outlet end of the sludge drying device oriented obliquely downward at an inclination angle of 0°-15°.

* * * * *